United States Patent [19]

Bell

[11] 4,028,864

[45] June 14, 1977

[54] MACHINE AND METHOD FOR PACKAGING FLAT ARTICLES SUCH AS PAPERBACK BOOKS OR THE LIKE

[75] Inventor: John T. Bell, St. Charles, Ill.

[73] Assignee: Container Corporation of America, Chicago, Ill.

[22] Filed: Mar. 16, 1976

[21] Appl. No.: 667,253

[52] U.S. Cl. ..... 53/24; 53/26; 53/37; 53/124 D; 53/154; 53/159; 53/284; 53/374

[51] Int. Cl.[2] ..... B65B 5/06; B65B 35/50; B65B 63/02

[58] Field of Search ..... 53/24, 26, 37, 50, 124 D, 53/154, 159, 162, 164, 242, 284, 374

[56] References Cited

UNITED STATES PATENTS 3,605,377 9/1971 Sabel ..... 53/164 X

*Primary Examiner*—Robert Louis Spruill
*Attorney, Agent, or Firm*—Carpenter & Ostis

[57] ABSTRACT

Apparatus is provided for packaging of flat articles, such as paperback books or the like, in a base number or multiples thereof, and includes structure for arranging the flat articles in a plurality of stacks and imposing a known pressure on each stack whereby the number within a given dimension is a constant, removing the desired number from the stack while retaining the remainder of the stack in position, enclosing the stacks in a container, adding additional flat articles to make the base number of multiples thereof, and closing the flaps of the container.

16 Claims, 24 Drawing Figures

31A
31
50
32
32
PB
63
62
71
33
33
69
68
73
61
73
72
74
74
35
122
34
34
115
102
103
42
102
34
34
42
34
34
103
121
119
35
116

31
PB
54
54
51
62
63
67
17
41
31
19
38
43
101
34
SC
118
117
116
104
109
107
106
108
113
111
112
SC
46

MACHINE AND METHOD FOR PACKAGING FLAT ARTICLES SUCH AS PAPERBACK BOOKS OR THE LIKE

BACKGROUND OF THE INVENTION

The invention herein is primarily directed to the packing of flat articles, such as paperback books or the like. These are customarily shipped in containers for 25 books or multiples thereof, e.g., 50, 70 or 100. Desirably, the books are arranged in four stacks within the container, and extra copies necessary to make the total desired number are arranged over the four stacks in a three article row or layer superimposed over the top articles in the stacks. This is made necessary by reason of the fact that the loaded containers are stacked one atop the other, and the arrangement of the extra copies within the loaded container minimizes marring of the nether books by the superimposed loads.

By way of example, in a container of 25 books, the books are arranged in four stacks of four books each, with nine books arranged in three layers of three books in each and superimposed over portions of four stacks. For fifty books, there are four stacks of 11 each, with six books arranged in two layers, three to a layer superimposed thereon. In case of 75 books, four stacks of 18 each, with a single layer of three books arranged thereover. Other combinations may be apparent from the teachings herein.

One of the problems present in the paperback book industry is the determination of the proper count for packaging purposes. The books are delivered from the trimmer and edge coater at such a speed that they cannot be readily counted on an individual basis. It is to such a problem that this invention is addressed.

In one aspect of the invention, the books are removed from a "log" conveyor, where thay are disposed along their backs or their opposite edges, by a step-by-step pocketing conveyor. The latter conveyor moves three groups of books to a position where each of the groups moves through an angle of 90° where the books then rest on their sides instead of their edges or backs.

When in the latter position, some of the books are transferred, to additional structure for counting by measurement, loading into a shipping container and subsequent closing of the flaps of the container. One of the newly-formed piles moves on a bypass conveyor for supplying books for the extra ones making up the base number of the books or the multiples thereof.

The remaining stacks for counting by measurement, form an important additional phase of the invention. While the stacks of books are undergoing a known pressure, the proper number is sliced therefrom. According to the invention, the books are arranged in side-by-side stacks with a known load placed thereon, the amount of the load being related to a constant number of books. The constant number is removed while the remainder stay in position within a retaining guide ready for additional books to be loaded therein, and to be removed as a constant number thereof.

A number of stacks are enclosed within a container having conventional closure flaps, and books are added to the enclosed books to make the desired shipping module. Thereafter, the container is closed both from the top and bottom thereof, the latter being done in a fashion not taught by the art.

SUMMARY OF THE INVENTION

With the foregoing considerations in mind, the invention may be summarized as being for the purpose of packaging flat articles, such as paperback books or the like, in a manner whereby they may readily be loaded into a tube of a regular slotted container, for example, in base numbers of multiples thereof, the invention being characterized by mechanism for removing books from a conveyor where the books move along their edges, transferring the books from said mechanism in piles of the same to structure where a load is placed on the piles proportional to a desired number to be picked from the pile by measurement of a part of the stack thereof, moving stacks of the books into a container tube and closing the tube in a stacks of the books into a container tube and closing the tube in a unique manner.

The invention herein comprehends both structure and method for accomplishing the above purposes.

THE DRAWINGS

FIG. 3 is a block diagram illustrating the relationship of FIGS. 1A and 1B.

GENERAL DESCRIPTION OF THE APPARATUS

Figure 1A:
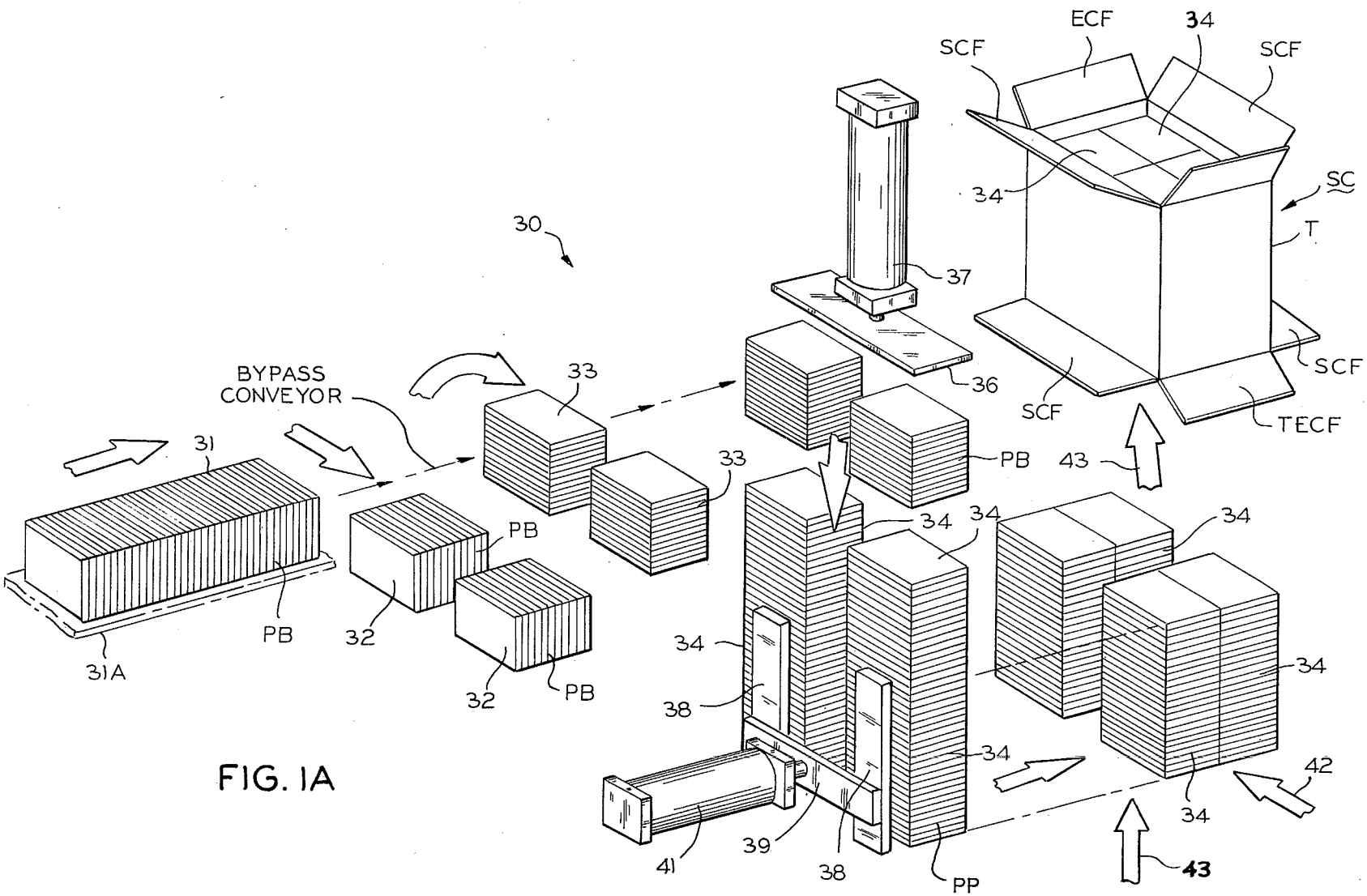
FIGS. 1A and 1B are in the nature of a flow diagram illustrating the functions occuring in the packaging apparatus according to the present invention.
Figure 1B:
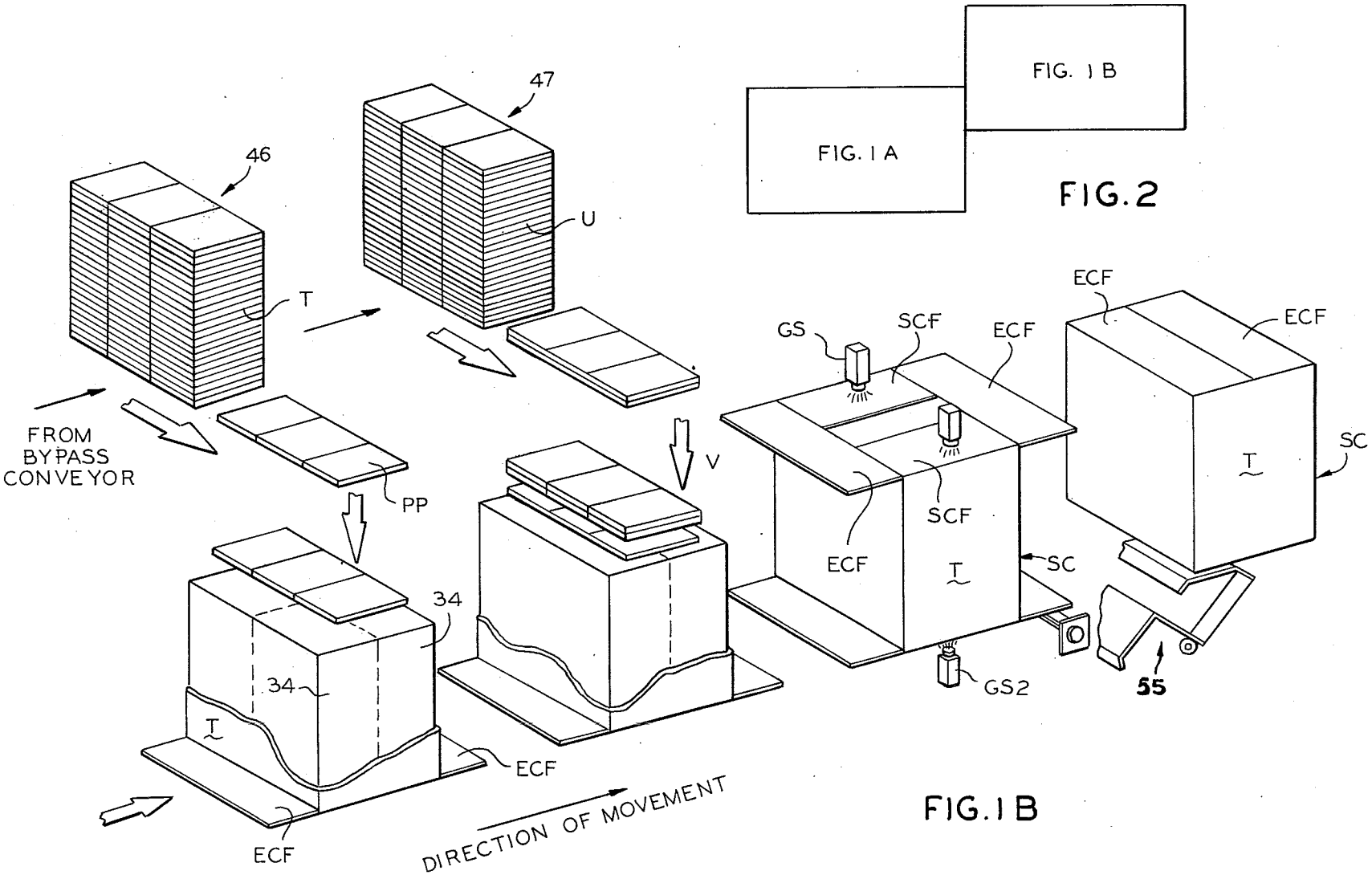

The general description of the invention apparatus, the method thereof, and its functions are best seen with respect to FIGS. 1A and 1B, wherein the invention apparatus is referred to generally by the reference numeral 30.

The apparatus is designed to package flat articles, such as bound and trimmed paperback books PB emerging from a trimming machine of the bindery and resting on their spines or edges in contacting relationship, and referred to as a "log" 31 moving along a "log" conveyor indicated generally by reference numeral 31A.

Figure 7:
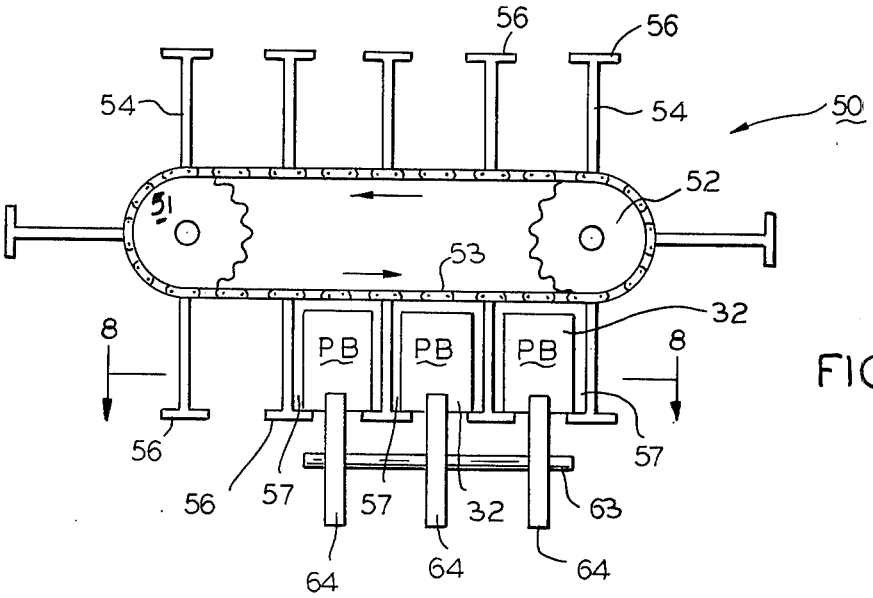
FIG. 7 is a schematic elevational view of an indexing conveyor for removing articles from an infeed conveyor.
Figure 8:
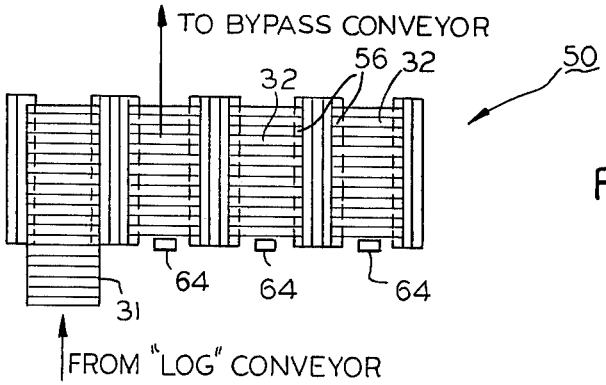
FIG. 8 is a view looking in the direction of the arrows 8—8 of FIG. 7.
Figure 13:
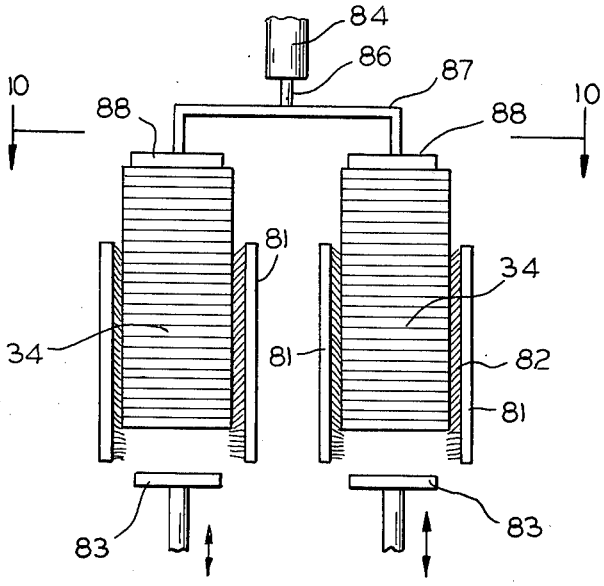
FIG. 13 is a schematic elevational view showing articles loaded into stacks for the counting of the articles.

Preferably, the books are removed from the log 31 by an indexing conveyor 50, see FIGS. 7, and 8, to provide three side-by-side piles 32, two of such piles being seen in FIG. 1, with the books still resting on their spines, from which position they are moved through 90°as seen in FIG. 1A to provide two small side-by-side piles 33. Structure will be described later for such purpose. The arrows seen illustrate the directions of movement to form the piles denoted by the numbers 33.

Additionally, books are removed from the log 31 to provide an additional pile, not seen in FIG. 1, to provide books for a bypass conveyor 35 for supply of additional books to make up a total number of books of 25, 50 or multiples thereof.

The small piles 33 are then placed atop a pair of stacks 34 and pressure is placed on the stacks by a pressure platen 36 activated by a pressure cylinder 37.

Following the formation of the piles 33, the books are moved translatively as denoted by the arrow thereat, with one pile 33 being loaded onto each stack 34, there being a pair of side-by-side stacks 34.

There is a stress-strain relationship between the number of books and their dimension in the stack 34, and a desired number of books are measured by vertical pressure platens 38 movable in a horizontal direction as indicated by the arrow. Measuring platens 38 are connected for conjoint movement by a cross member 39 and the platens 38 and cross member 39 are urged in the direction seen by a cylinder and piston arrangement 41.

Structure is provided for retaining the books PB in position while the nether books are moved away from the stacks 34. Such structure is of a type disclosed in an application of John T. Bell, Ser. No. 614,748, filed Sept. 18, 1975, for An Article Holding Mechanism. Such structure maintains the books PB in the upper parts of the stacks 34 in position, and upon retreat of the pressure platens 38, the cylinder 37 and its pressure platens 36 push additional books downward to reform the stacks 34 and place the proper pressure thereon, so that counting by measurement can again be achieved by the measuring pressure platens 38.

The measuring platens 38 are operable to slice off two stacks and these are urged together by pusher means indicated generally by the reference numeral 42 movable in the direction of the arrow thereat.

Figure 18:
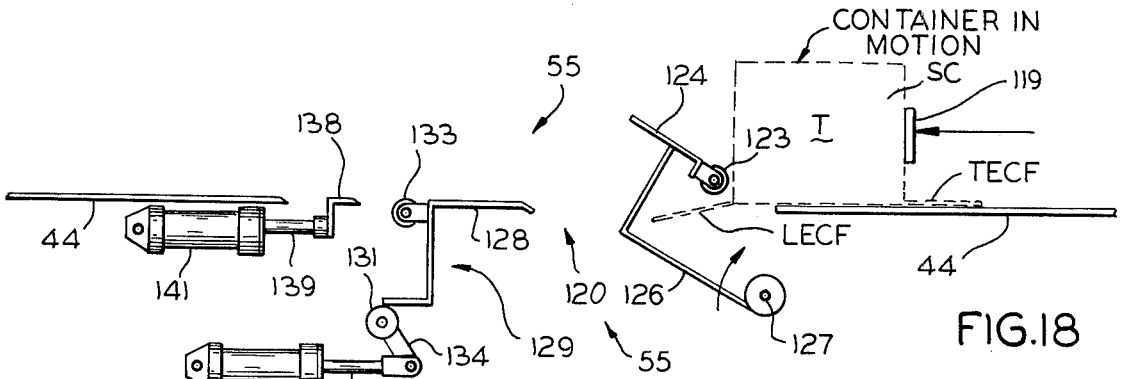
FIGS. 18 to 21 inclusive illustrate schematically structure for folding the bottom closure flaps of the container loaded with the articles.
Figure 21:
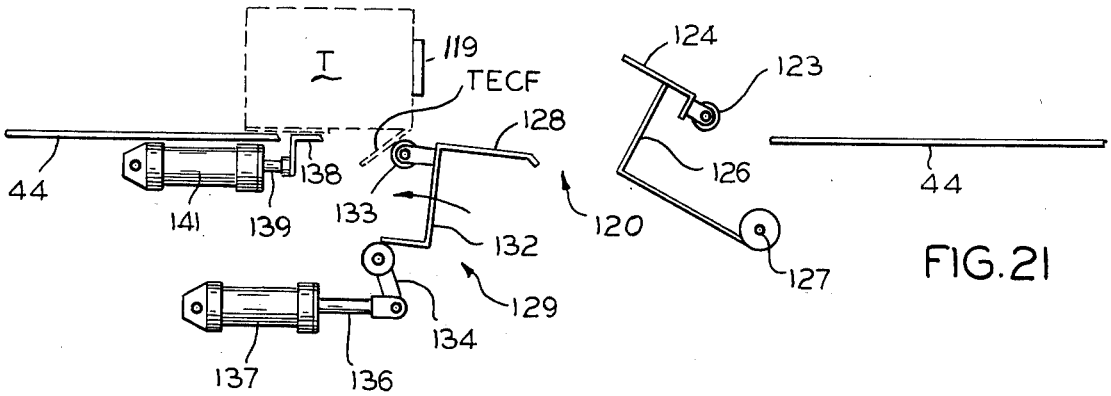

At this time the stacks 34 are ready for packing into a tube T of a shipping container SC having side closure flaps SCF and lower leading and trailing end closure flaps LECF and TECF, see also FIGS. 18 and 21.

The stacks 34, they being in two contiguous rows totalling four stacks, are arranged to be elevated into the tube T in the direction of the arrow at the bottom of the stacks 34 by means indicated generally thereat by the reference numeral 43.

After being loaded into the tube T, the stacked books 34 and tube T are moved in the direction seen in FIG. 1B, along a conveyor reach 116 of an intermittently operated conveyor referred to generally by the reference numeral 44, and as seen more particularly in FIGS. 3A and 3B and 5A and 5B.

As previously explained, the containers SC are of sizes to pack 25 articles or multiples thereof. The stacks 34 therein are supplied with additional books PB arranged in rows of three atop the four stacks 34. In the case of 25 books, four stacks of four books each have added thereto three stacks of three each; in the case of 50 books, for stacks of 11 each with three stacks of two each; in the case of 75 books, three stacks of one book each; and in the case of 100 books, four stacks of 25 each, which obviously do not require additional books.

The arrangement of the additional books in the stacks described enables the loaded container SC to be stacked atop each other without marring of the topmost books of the stacks 34 therein.

Accordingly, after the books PB are loaded into the tubes T, structure is provided for placement of the additional books atop the stacks 34. One of such structures is denoted generally by the reference numeral 46 and the other generally by the reference numeral 47. Books for the structures 46 and 47 are supplied from the bypass conveyor 35, and the stacks seen at structures 46 and 47 may be arranged by hand or mechanical means.

Stack 46 includes a bottom shuttle feed well known in the art for feeding a row of three books PP in a one high layer atop the stacks 34. Stack 47 is provided with a like shuttle for feeding a row of three books in a stack two high atop a container having 50 books packed therein, and its operation may be combined or separate from the other according to the number of books being packed.

Circuit means, not shown, are provided for controlling the operation of structures 46 and 47 according to whether the containers SC are to contain 25, 50, 75 or other multiples of 25.

Prior to the placement of the additional books, the bottom side closure flaps SCF are folded to closing position below the stacks 34, the bottom end closure flaps LECF and TECF remaining in the unclosed position.

After placement of the additional books atop the stacks 34, the upper closure flaps are glued and closed in the conventional manner at glue stations GS, the lower side closure flaps SCF having glue applied thereto at glue stations GS2.

It will be remembered that the leading and trailing end closure flaps LECF and TECF are still in the unclosed position, to be closed by structure as will be described.

The bottom closure flaps ECF and SCF are closed while the loaded containers SC move along conveying reach 44. Closing of the bottom side closure flaps SCF is done in a conventional manner by the usual plow arrangement, while the clogging of the bottom end closure flaps LECF and TECF, which lead and trail the bottom of the loaded tube T is achieved by structure denoted generally by the reference numeral 55, and is described in more detail with reference to FIGS. 18 to 21 inclusive. The structure for closing bottom flaps of the container is more fully described in an application of John T. Bell dealing with that subject matter.

DETAILED DESCRIPTION OF APPARATUS

The articles, such as the paperback books PB, move as a log 31 along the log conveyor 31A, the books at the end thereof being sliced off and moved along an indexing conveyor indicated generally by the reference numeral 50. It is seen in detail with particular reference to FIGS. 7 and 8. Conveyor 50 includes spaced sprockets 51 and 52 around which is trained a sprocket chain 53. Regularly spaced book trapping flights 54 are carried by the chain 53 to move in orbital fashion, the flights 54 being adapted to trap the books therebetween when the flights 54 are moving in the lower reach of conveyor 50.

Each of the flights 54 is provided with feed 56 affording a support for the books PB as they move from the log 31 to a position between flights 54.

The conveyor 50 moves in step-by-step fashion until three adjacent pockets 57 defined by the flights 54 are each loaded with the books. At such time loading of the conveyor 50 is completed, structure is provided for unloading of the books in a fashion whereby some of the books are transferred to the bypass conveyor 35 and the others are handled in accordance with the teachings herein. As seen in FIGS. 7 and 8, the left-most pocket 57 has the books therein transferred to bypass conveyor 35 while the two right-most pockets 57 have the books therein transferred to positions for stacking, counting, insertion into a carton and the subsequent closing of the carton.

Structure is provided for moving the books PB from the pockets 57, rotating each group thereof through 90° whereby the books rest upon their sides instead of their spines or edges. To this end there is provided a rotating conveyor 61 having a central hub 62, see FIGS. 3A, 7, 9 and 12 particularly, turning fast on a shaft 63. Hub 62 has a plurality of arms 64 extending therefrom defining 90° apart pockets 66 for receiving books pocketed between adjacent flights 54.

The arms 64 are arranged to pass between the spaced flights 54 seen in FIG. 7, and upon rotation of the arms 64 through 90°, a stack of books 33 resting upon their sides is delivered to position for movement translatively along a feed shelf 67.

It should be noted at this point that the description following will be related to books to be loaded into the shipping containers SC in stacks therewithin. However, the structure just described for moving the books through the 90° angle described is also for the purpose of delivering a stack thereof to the bypass conveyor 35 seen in FIGS. 3A and 3B.

Also, it should be noted that the functions already described and to be described are under control of circuitry not described, and believed to be within the skill of one in the art.

Figure 3A:
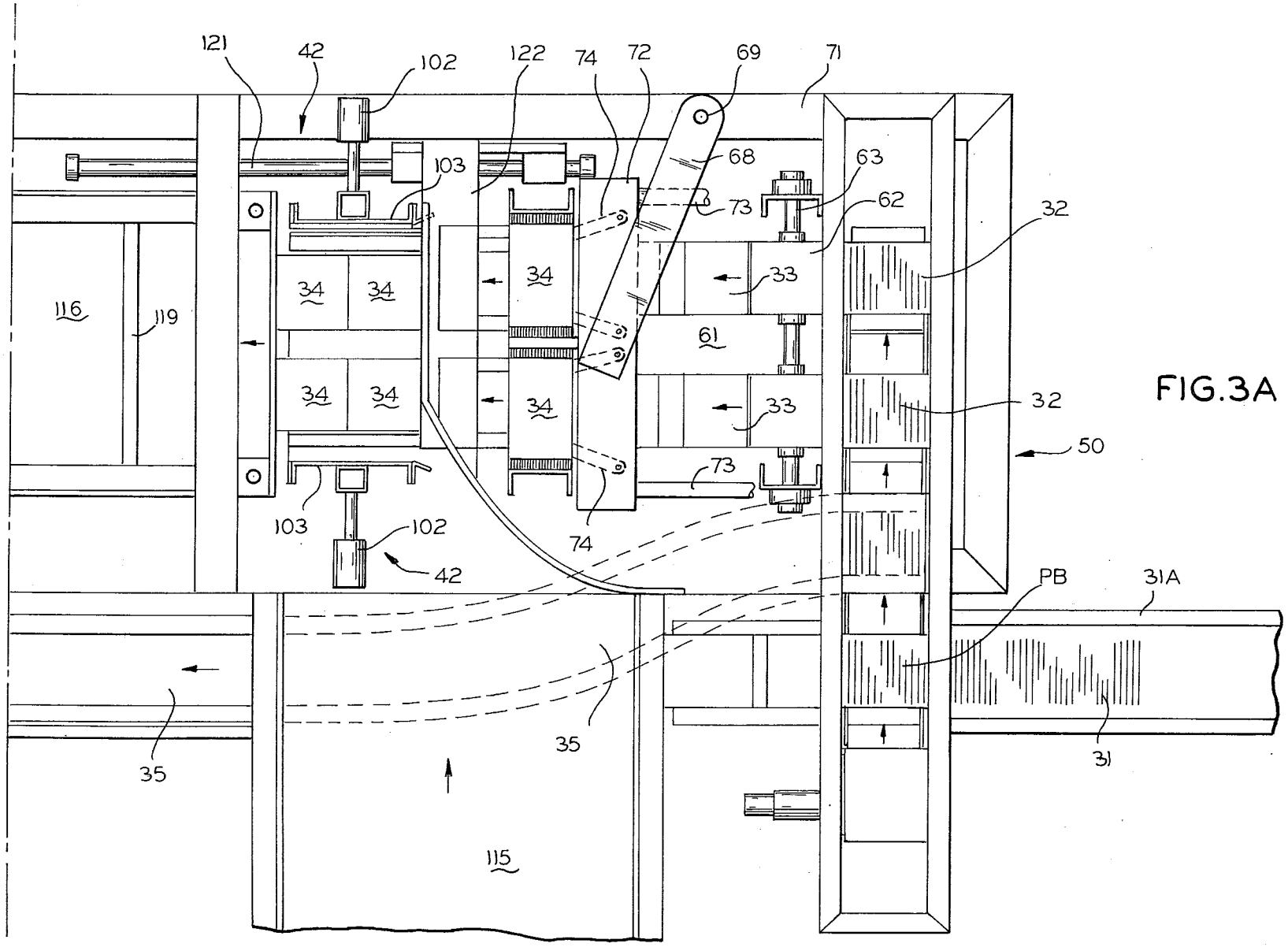
FIGS. 3A and 3B are plan views of apparatus performing the functions seen in FIGS. 1A and 1B.

Structure is provided for moving a pair of the stacks 33 seen in FIG. 3A to form a higher pair of stacks 34 for subsequent measurement of a desired quantity of the books therein and removal of such measured quantity therefrom. To this end there is provided a sweep arm 68 mounted for angular movement with a vertical rock shaft 69 mounted in a frame member 71.

Sweep arm 68 is pivotally connected to a sweep 72 guided for lateral movement of itself upon spaced guide rods 73. Sweep 72 extends in spaced relationship to the tops of the stacks 33 and is provided with vertical downward extending pusher members 74 pivoted at 76 to abutments 77 disposed on the sweep 72, see FIGS. 10 and 11. A pair of pusher members 74 is disposed at each stack 33, and each pusher member 74 is guided for limited pivotal movement by a pin 78 extending from each and guided in an arcuate slot 79. The pusher members 74 are lightly biased toward each other by a coil spring 81 attached at each end to a pusher member 74.

It should be noted that sweep 72 and pusher members 74 clear the arms 64 of the rotating conveyor 61.

Figure 9:
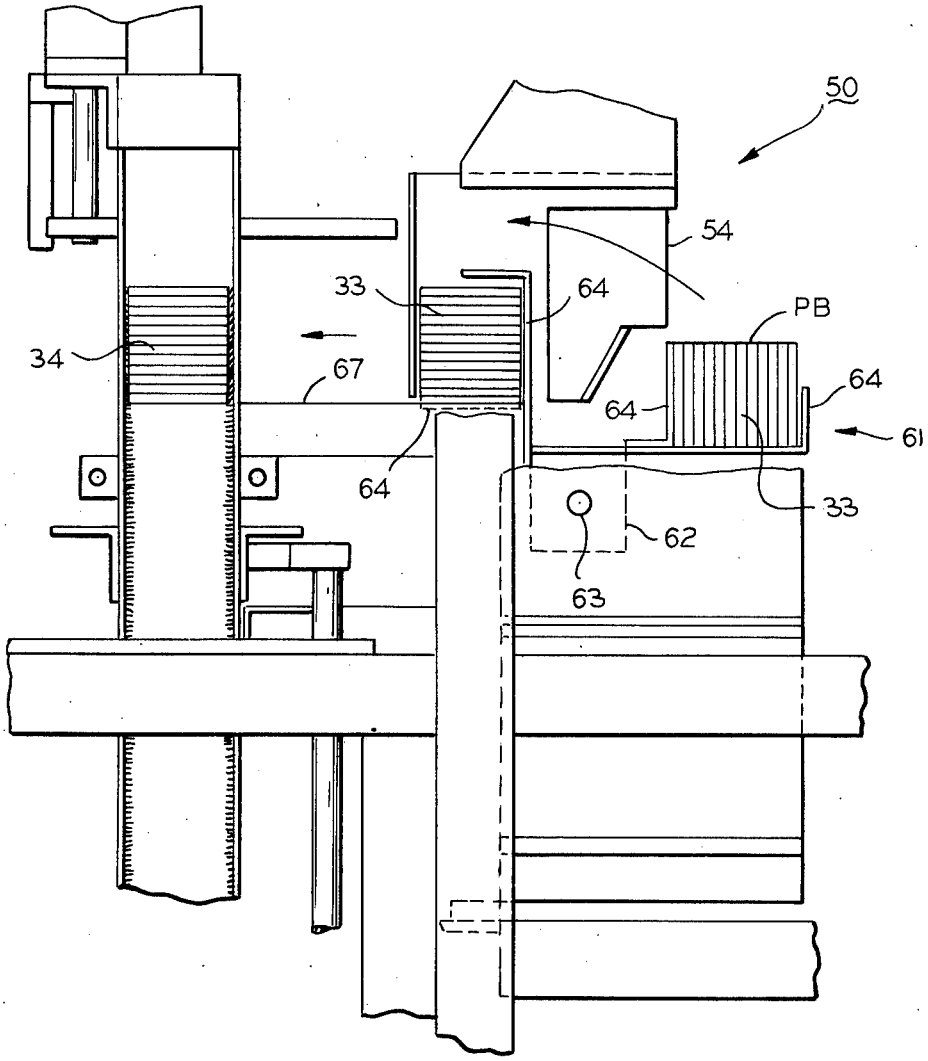
FIG. 9 is a somewhat schematic elevational view showing further details of the structure for transferring the articles from the index conveyor seen in FIG. 7.
Figure 10:
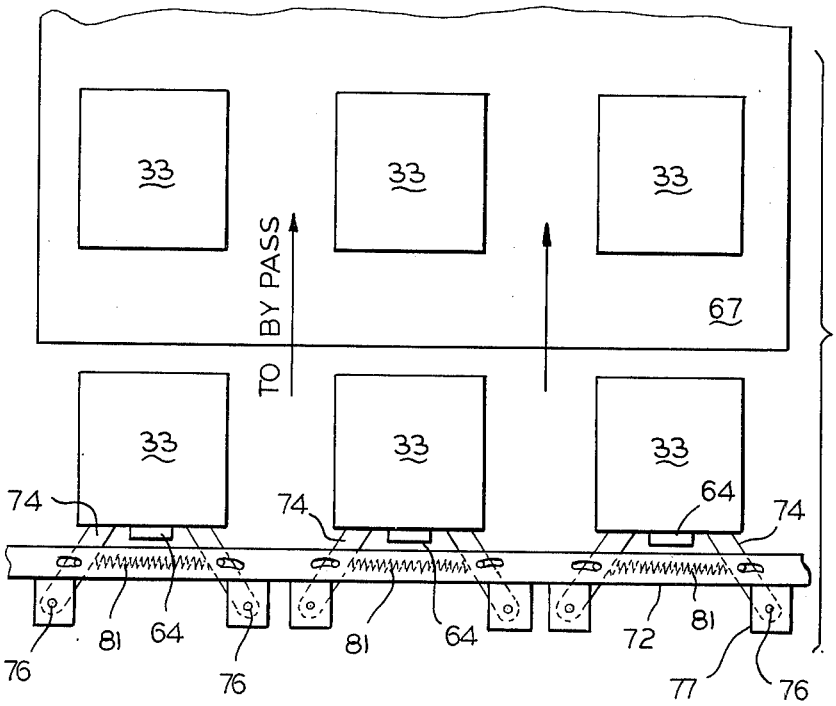
FIG. 10 is a schematic plan view showing structure for removing articles from the transfer conveyor.
Figure 11:
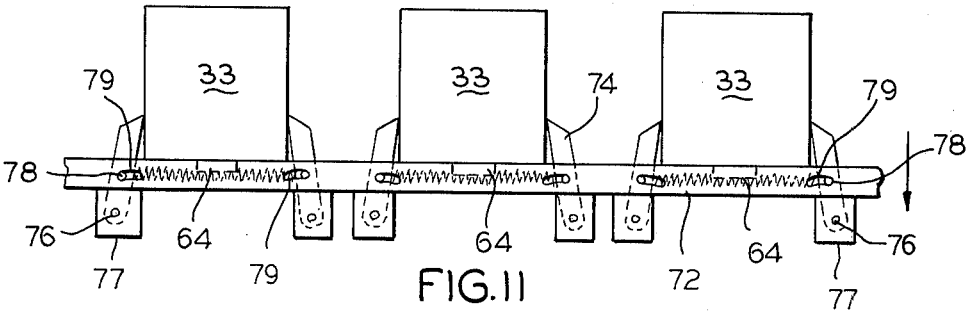
FIG. 11 is a similar view showing a step in the operation of such structure.
Figure 17:
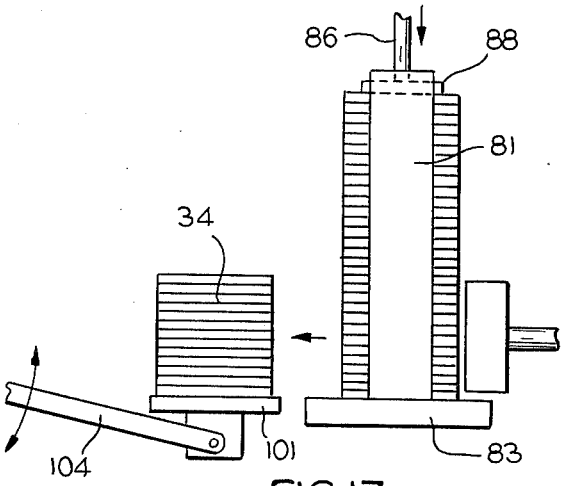
FIG. 17 is a schematic elevational view showing structure for removing a counted group of articles from the lower portion of the stack and transferring the articles to a position for enclosing same into a container.
Figure 12:
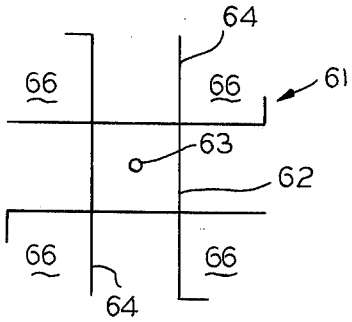
FIG. 12 is a schematic end elevational view of the transfer conveyor for removing articles from the index conveyor of FIG. 7.
Figure 14:
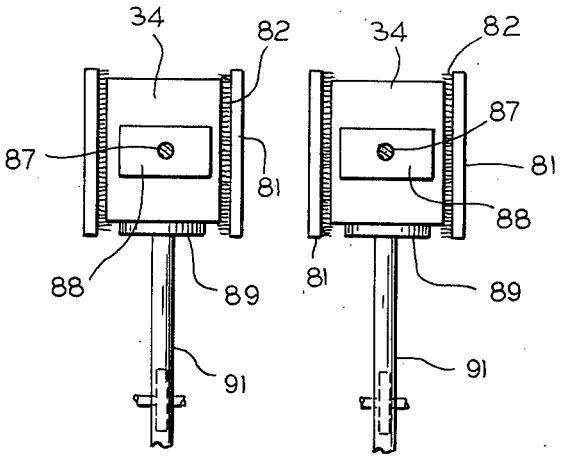
FIG. 14 is a schematic plan view showing structure for transferring articles from the stack of FIG. 13.
Figure 15:
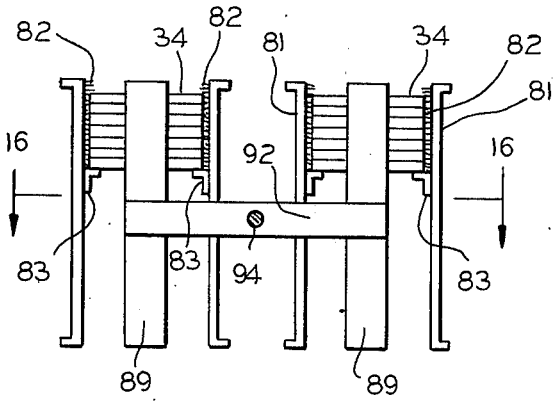
FIG. 15 is a schematic elevational view showing structure for removing articles from the lower part of each stack.
Figure 16:
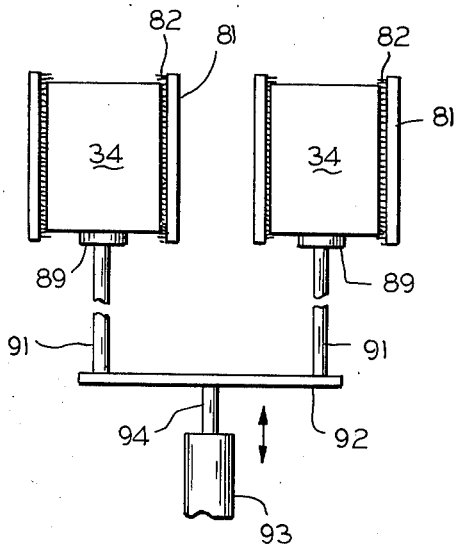
FIG. 16 is a view looking in the direction of the arrows 16—16 of FIG. 15.

The steps taking place in removing a stack 33 from the rotating conveyor are illustrated best in FIGS. 10 and 11, where in FIG. 10 there is shown a plurality of stacks 33 which have been removed from rotating conveyor 61 and resting upon feed shelf 67. Sweep 72 and pusher member 74 are now engaged with a second stacks 33 to advance the second stacks 33 over feed shelf 67 to position atop higher stacks 34 as seen in FIGS. 3A and 9, and a load is placed on the stack 34 for the purpose of counting the number of books by measurement, as previously discussed.

Return movement of the pusher members 74 is illustrated in FIG. 11, the sweep 72 retreating with the ends of pusher member 74 riding past the sides of the stacks 33. Prior to such return movement the rotating conveyor 61 has indexed to position with additional stacks 33 therein.

Referring now to FIGS. 13 to 17 inclusive, the stacks 33 on feed shelf 67 are pushed by sweep 72 atop higher stacks 34. The books of stack 34 are retained between a pair of vertical side rails 81 each lined with restraining devices 82 described heretofore.

The lower ends of the stacks 34 rest upon adjustable angle members 83, and structure is provided for imposing a vertical load on the books PB of a known amount to the end that there is a known relationship between the number of books within a known vertical dimension and the load thereon. To this end pressure is placed against stack 34 by a pressure cylinder 84 having a piston rod 86 secured to a yoke 87 terminating in pressure platens 88 bearing against the top of the stacks 34. Measured cut-off for paperback books is more fully described in John T. Bell application dealing with that subject matter.

A known quantity of books are sliced from the lower ends of the stacks 34 by measuring structure including vertically extending pushers 89 secured to push rods 91 secured at their other ends to a yoke 92. As cylinder 93 has a piston rod 94 connected to yoke 92, and upon actuation of cylinder 93 the books at the lower end of the stacks 34 are sliced therefrom. As movement of the pushers 89 takes place, the pressure from cylinder 84 on stacks 34 is relieved. The restraining devices 82 retain the books in position until cylinder 93 returns to its start position, whereupon the stacks 34 are again loaded from the stack 33, the stacks moving downward to the angle members 83 to be subsequently loaded by application of pressure by cylinder 84.

Figures 5A, 5B, 6:
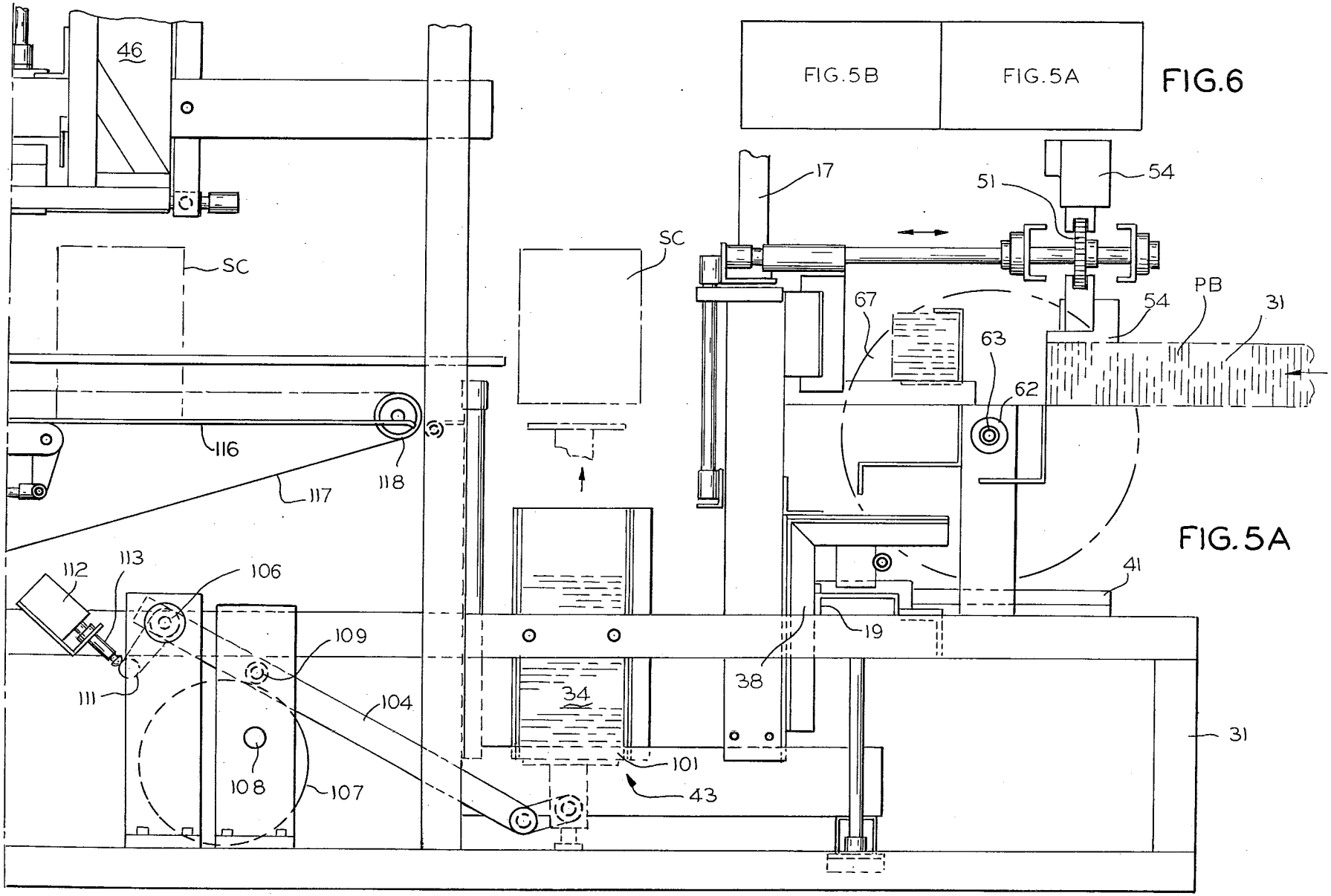
FIGS. 5A and 5B are elevational views corresponding respectively to the plane view of FIGS. 3A and 3B.
FIG. 6 is a block diagram illustrating the relationship of FIGS. 5A and 5B to each other, and the functions taking place as illustrated in said figures.
Figure 5B:
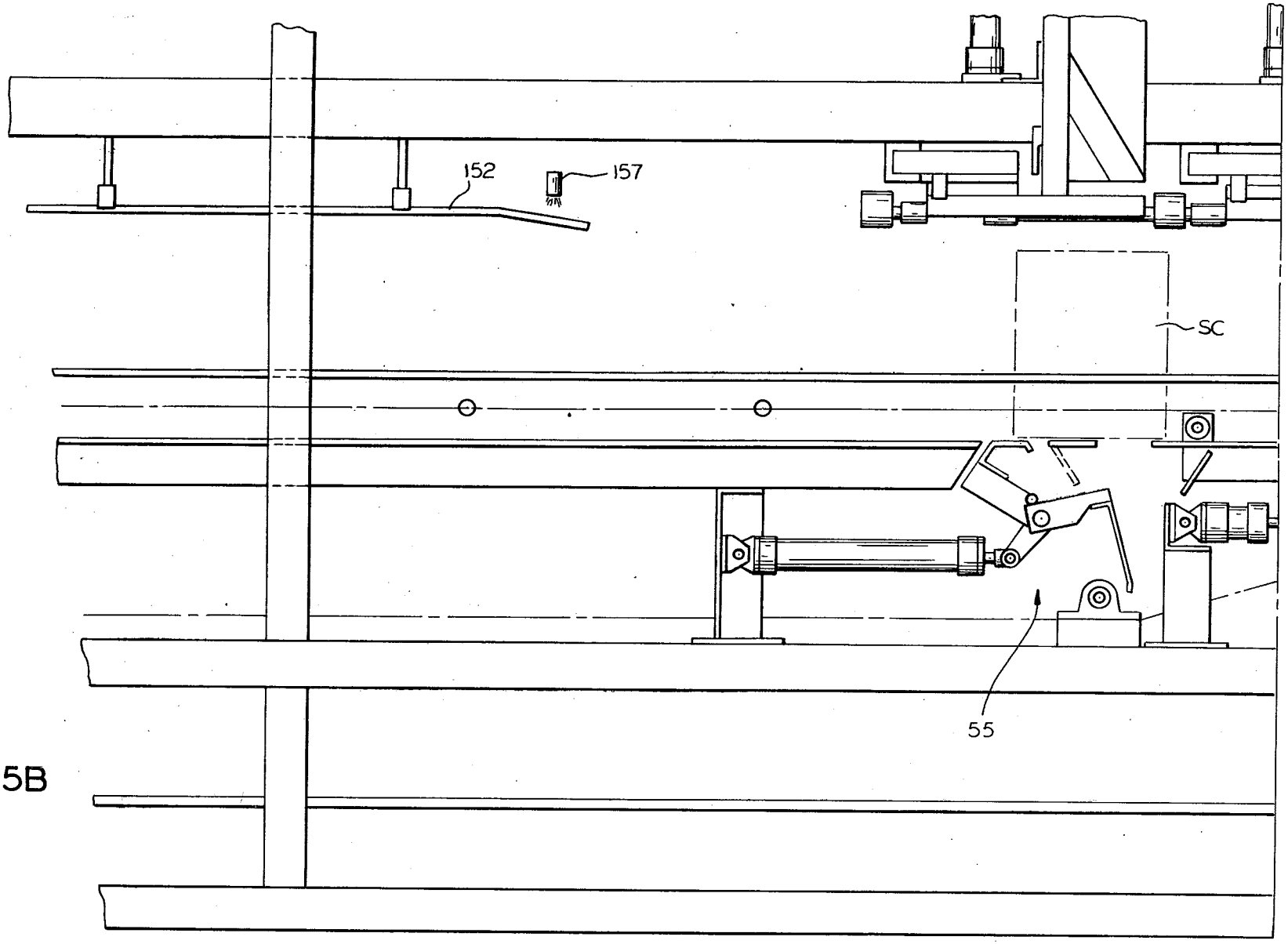

The operation of the pushers 89 is such as to place the measured (counted) stacks onto a platform 101 of the elevator 43, see also FIG. 5A, movable in a vertical direction to raise four contiguous stacks 34 arranged in two rows. Prior to raising of the stacks they are pushed together by air cylinders 102 and platens 103 to position the stacks 34 as just described, see also FIG. 3A.

The platform 101 is mounted at the end of a lift arm 104 movable angularly about a pivot 106. Lift arm 104 moves angularly by rotating eccentric 107 turning with a motor driven shaft 108, the arm 104 having an eccentric follower 109 thereon.

The platform 101 is varied in the amount of its vertical movement by a crank arm 111 fast to lift arm 104 at its pivot point, crank arm 111 and lift arm 104 being adjusted in position by a cylinder 112 having a position piston rod 113 bearing against crank arm 111.

The depth of the stacks 34 within the rails 81 as determined by the angle members 83 determines the number of books being sliced off, and the position of platform 101 at the lowest point thereof is adjusted by piston rod 113, so that angle members 83 and platform 101 lie in a common plane.

Hopper structure is provided for placing a container tube T about the stacks 34, which have been raised by platform and such structure is indicated generally by reference numeral 115, see FIG. 3A.

Conventional gripping elements (not shown) traverse directly across the machine in perpendicular relationship to tubes T and grasp a panel of the tube T. The gripping elements reverse direction pulling the tube from the hopper 115. A second panel of the tube T, not gripped by the gripping elements, strikes a plow bar 123 thereby forcibly folding said second panel to the rear and forcing the tube T to open and be positioned over the accumulated stacks of books 34. With tube T held in a fully opened position, platform 101 raises the stack 34 into container T. The platform 101 retains the stacks 34 in position as the sweep 122 moves the stacks now enclosed in the container tube T to an endless stepping conveyor 117 moving the loaded container tube T along the reach 116. Conveyor 117 has conventional endless strands reeved between paired sprockets 118, there being flights 119 carried by the strands for engaging the loaded tubes T.

Sweep 122 rides on a longitudinally fixed rod 121 to move loaded tube T onto the reach 116 where it is indexed forward by flights 119.

Figures 3B, 4:
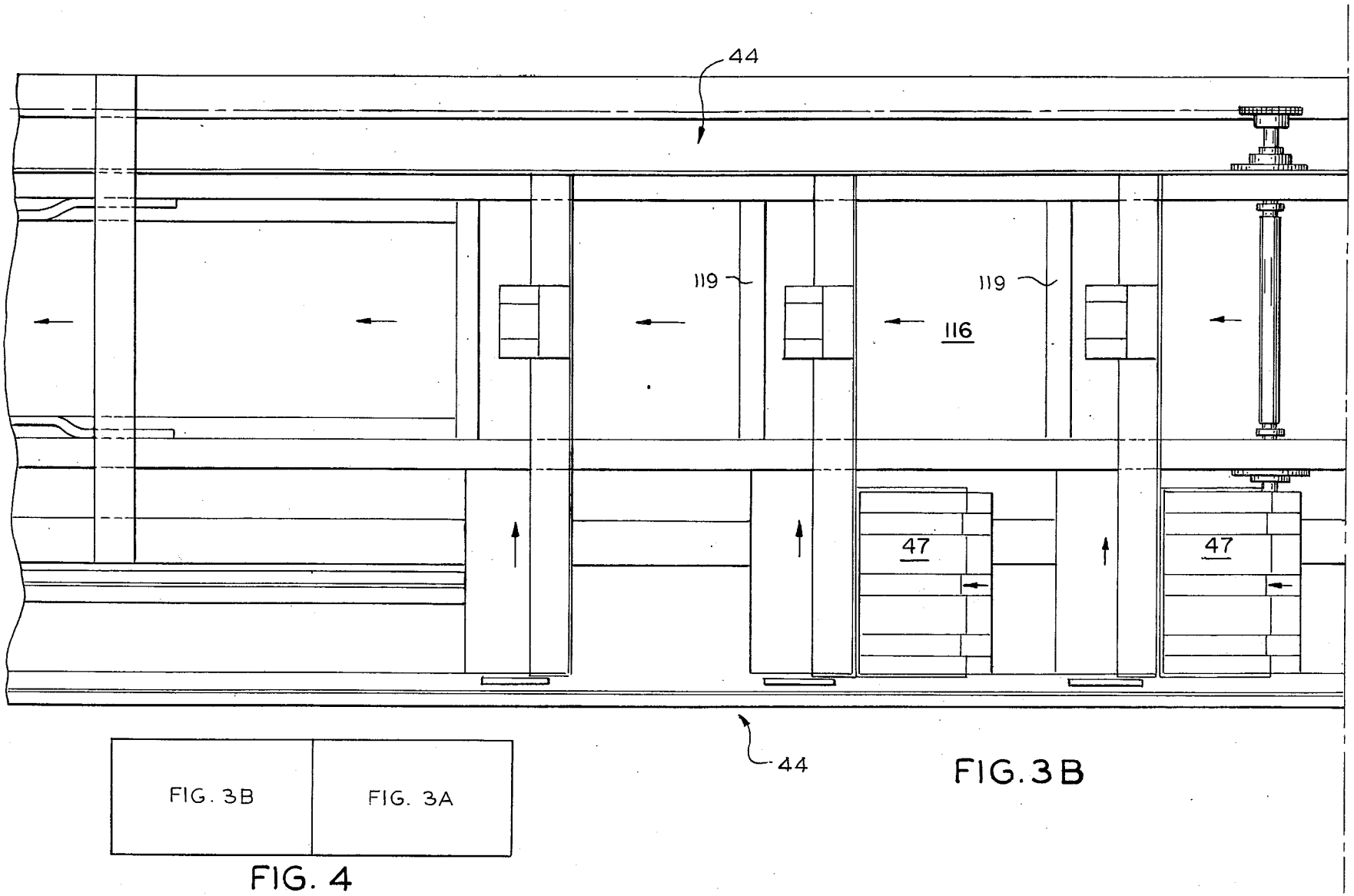
FIG. 4 is a block diagram illustrating the relationship of the apparatus of FIGS. 3A and 3B and the functions taking place as illustrated in said figures.

In the step-by-step movement of the loaded container along reach 116 the additional books are loaded therein as described with reference to FIGS. 1A and 3B. Thus, the container will stop at shuttle conveyor 46 for loading thereinto of three additional books; then at shuttle conveyor 47 for loading of six additional books if that number be needed. The shuttle conveyors 46 and 47 are under control of circuitry, not shown, according to whether three, six of nine additional books are to be loaded.

The shuttle conveyors 46 and 47 are shown schematically as they are well known in the art. Details of their construction appear to be unnecessary.

As seen in FIGS. 1A and 1B, since the container tube T is placed around the grouped books from above, the bottom closure flaps are still not sealed. Referring back particularly to FIG. 1B, the closing mechanism for the leading and trailing bottom closure flaps ECF has been denoted by the reference numeral 55. The tube T of shipping container SC moves along the conveyor reach 116 in step-by-step fashion as by an intermittently moving flight 119. The tube T of container SC has leading and trailing end closure flaps LECF and TECF moving in facing relationship with conveyor reach 116.

The containers SC have already been loaded with the proper number of articles, as has been explained. As the containers move along conveying reach 116 the lower side closure flaps are folded against the container contents, such folding being achieved by the conventional plows well known in the art.

While so moving along the conveyor reach 116, which is provided with slots, not shown, the exposed surfaces of lower side closure flaps SCF are coated with adhesive at such slots preparatory to sealing the lower end closure flaps LECF and TECF. The articles within the container are supported in part by the closed side closure flaps SCF which are in contact with conveyor reach 116.

As seen in FIG. 18, container SC approaches a discontinuity 120 in conveying reach 116. As loaded container SC approaches same, the leading face of container SC engages a roller 123 mounted at the end of an arm 124 secured to the free end of an L-shaped rock arm 126 mounted on a shaft 127 and spring biased in the direction seen. As container SC advances under urging of flight 119, roller 123 contacts leading end closure flap LECF to force it against the already closed side flaps SCF seen in FG. 1B.

Container SC advances over arm 125 until it moves over a flat arm 128 of a bell crank 129 pivoted about a dead shaft 131. Bell crank 129 also has an arm 132 having a roller member 133 extending therefrom.

Bell crank 129 includes a rock arm 134 turning therewith about dead shaft 131, and rock arm 134 is pivotally connected to a piston rod 136 of a cylinder 137.

Figure 19:
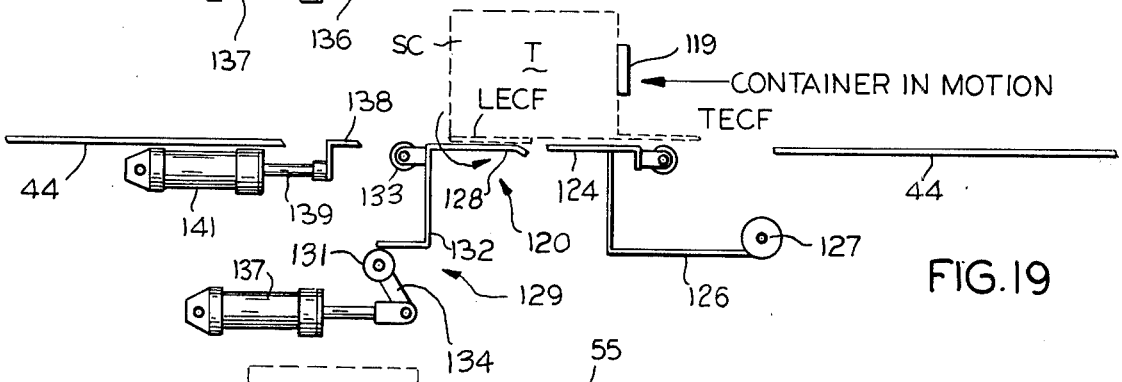

As container SC moves to the left as seen particularly in FIG. 19, it advances over flat arm 128, which is now in the plane of conveyor reach 116. Continued movement of container SC is over a flat support member 138 joined to a piston rod 139 of a cylinder 141. As member 138 engages the now sealed leading flap LECF, cylinder 137 is actuated to rock bell crank 129 in a clockwise fashion with flat arm 128 now beneath the plane of conveyor reach 116.

Container SC is now arrested, and bell crank 129 is rocked in a counter-clockwise direction until the roller member 133 engages the trailing flap TECF, the continued rocking movement of crank 129 closing the trailing closure flap against the already closed side closure flaps SCF.

Figure 20:
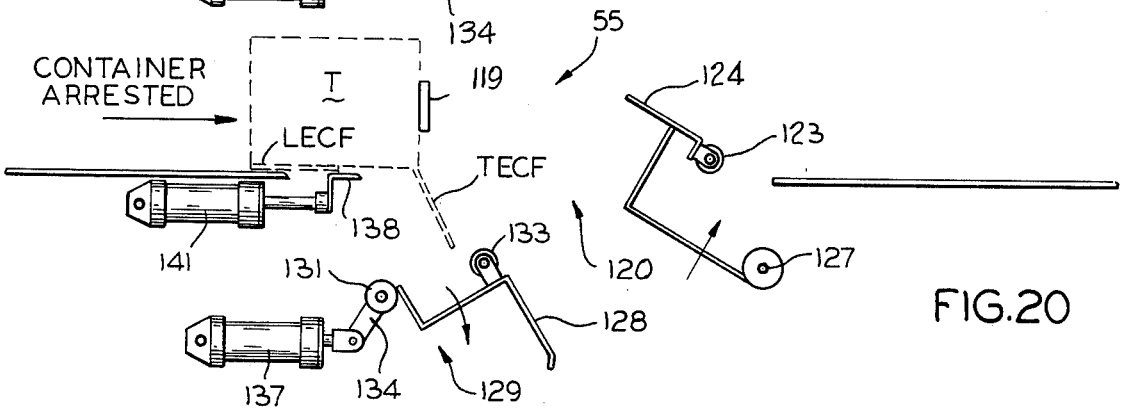

At the conclusion of the operation seen in FIG. 20 container SC resumes movement by flight 119. Meanwhile, after container SC has moved past arm 124, rock arm 126 supporting same moves to the start position seen in FIG. 18 for resumption of the steps recited.

During the counter-clockwise movement of bell crank 129, support 138 is released from already closed leading flap LECF, by operation of cylinder 141, support 138 moving beneath said flap and out of the way of the closing operation of bell crank 129 and roller 133. By this time container SC is supported at discontinuity 120.

After completion of the closing operation, cylinder 141 is operated in a reverse direction to resume the position seen in FIG. 18.

The closing of the upper flaps of containers SC is done at stations where glue is applied to such flaps, they being subsequently moved to closing position by plows or other closing devices well known in the art. Such gluing stations for the upper closure flaps are denoted by reference numeral 151 and plows 152. As seen in FIG. 5A such closing is done after loading of the extra books at shuttles 46 and 47 and after bottom closing has been completed as described with reference to FIGS. 18 to 21.

I claim:

1. Apparatus for packaging flat articles, such as books or the like, arranged in one or more adjacent stacks of equal numbers in a shipping container, said apparatus comprising:

a. means for placing said articles in side-by-side stacks with the sides of said articles in contact with each other;

b. means for imposing a controlled pressure load on the stacks to compress the articles so that a predetermined number of articles of each stack has a constant dimension;

c. means for removing a predetermined number of articles from said stacks thus constituting removed articles, said means including means for restraining the articles remaining in said stacks;

d. means for enclosing the removed articles in a shipping container having closure flaps thereon;

e. means for selectively adding additional articles to said enclosed removed articles to provide a desired number of articles within said container;

f. means for closing the closure flaps of said shipping container.

2. Apparatus according to claim 1 including conveyor means for removing said flat articles from a feed conveyor wherein said articles are moved thereon while resting along the edges thereof.

3. Apparatus according to claim 2 wherein said conveyor means moves in step-by-step fashion and is provided with flights for trapping articles therebetween.

4. Apparatus according to claim 3 wherein some of the articles are removed from said conveyor means to a bypass conveyor for supplying articles to be added to said enclosed stacks.

5. Apparatus according to claim 2 wherein means are provided for removing articles from said conveyor means and placing said articles in stacks wherein said articles rest up on their sides.

6. Apparatus according to claim 5 wherein the removing means consists of rotating conveyor.

7. Apparatus according to claim 3 wherein a rotating conveyor removes articles trapped between said flights and places said articles in stacks wherein said articles rest upon their sides.

8. Apparatus according to claim 7 wherein means are provided for removing said stacks from said rotating conveyor.

9. Apparatus according to claim 8 wherein said removing means is adapted to place said stacks atop previously formed stacks.

10. Apparatus according to claim 1 wherein the article adding means includes feed devices for feeding rows of articles of a selected number to load said container with a total desired number of articles.

11. Apparatus according to claim 1 wherein said container is placed over said stacks and means are provided for conveying said container with said stacks therein to position for additional loading by said article adding means.

12. The method of packaging flat articles such as books or the like in a shipping container with a base number of said articles or in multiples of said base number in said container, said articles being stacked in said container in a plurality of side-by-side individual stacks, said method comprising the steps of:

a. placing said articles in side-by-side stacks with the sides of said articles in contact with each other;

b. imposing a load of a controlled amount whereby the number of articles within a given dimension of the stack is a constant;

c. removing a constant number of articles from said stacks and restraining the articles remaining in said stacks for subsequent removal;

d. enclosing the removed stacks in a container having a closure flaps thereon;

e. adding articles to said enclosed stacks selectively to provide a desired number of said articles within said container;

f. closing the closure flaps of said container.

13. The method according to claim 12 including the step of moving said flat articles resting along the edges thereof from a feed conveyor.

14. The method according to claim 13 including the step wherein said articles move in step-by-step fashion and are trapped in separate groups.

15. The method according to claim 13 including the step of placing the articles in stacks wherein the articles rest up on their sides.

16. The method according to claim 15 including the step of moving the articles rotatively.

* * * * *